US011639573B2

(12) United States Patent
Ashrafzadeh et al.

(10) Patent No.: US 11,639,573 B2
(45) **Date of Patent: *May 2, 2023**

(54) LAUNDRY TREATING APPLIANCE WITH IMAGING CONTROL

(71) Applicant: WHIRLPOOL CORPORATION, Benton Harbor, MI (US)

(72) Inventors: Farhad Ashrafzadeh, Stevensville, MI (US); James P. Carow, Saint Joseph, MI (US); Shreecharan Kanchanavally, Lisle, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 274 days.

This patent is subject to a terminal disclaimer.

(21) Appl. No.: 17/069,352

(22) Filed: Oct. 13, 2020

(65) Prior Publication Data

US 2021/0025106 A1 Jan. 28, 2021

Related U.S. Application Data

(63) Continuation of application No. 16/145,949, filed on Sep. 28, 2018, now Pat. No. 10,829,886, which is a (Continued)

(51) Int. Cl.

| | |
|---|---|
| ***D06F 34/18*** | (2020.01) |
| ***D06F 58/30*** | (2020.01) |
| *D06F 58/04* | (2006.01) |
| *D06F 101/00* | (2020.01) |
| *D06F 103/02* | (2020.01) |
| *D06F 105/24* | (2020.01) |
| *D06F 105/48* | (2020.01) |
| *D06F 105/50* | (2020.01) |
| *D06F 105/60* | (2020.01) |

(52) U.S. Cl.

CPC ..... *D06F 34/18* (2020.02); *D06F 58/30* (2020.02); *D06F 58/04* (2013.01); *D06F 2101/00* (2020.02); *D06F 2103/02* (2020.02); *D06F 2105/24* (2020.02); *D06F 2105/48* (2020.02); *D06F 2105/50* (2020.02); *D06F 2105/60* (2020.02)

(58) Field of Classification Search

CPC ..... D06F 34/18; D06F 58/30; D06F 2101/00; D06F 2101/02; D06F 2105/24; D06F 2105/48; D06F 2105/50; D06F 2105/60

USPC ..... 34/108

See application file for complete search history.

(56) References Cited

U.S. PATENT DOCUMENTS

| | | | |
|---|---|---|---|
| 5,345,060 | A | 9/1994 | Hazan et al. |
| 5,391,890 | A | 2/1995 | Migliorini |

(Continued)

FOREIGN PATENT DOCUMENTS

| | | | |
|---|---|---|---|
| DE | 3938822 | A1 | 5/1991 |
| DE | 19961459 | A1 | 7/2001 |

(Continued)

*Primary Examiner* — John P McCormack

(74) *Attorney, Agent, or Firm* — McGarry Bair PC

(57) ABSTRACT

A laundry treating appliance having a rotatable drum defining a laundry treating chamber, where the laundry in the laundry treating chamber may be imaged and a condition of the laundry determined based on the imaging of the laundry. A notification can be provided to a user based on the determined motion condition.

19 Claims, 11 Drawing Sheets

Related U.S. Application Data continuation of application No. 15/046,033, filed on Feb. 17, 2016, now Pat. No. 10,113,263, which is a continuation of application No. 14/022,132, filed on Sep. 9, 2013, now Pat. No. 9,279,213, which is a continuation of application No. 12/388,605, filed on Feb. 19, 2009, now Pat. No. 8,528,229.

(56) References Cited

U.S. PATENT DOCUMENTS

| | | | | |
|---|---|---|---|---|
| 5,755,041 | A | 5/1998 | Horwitz | |
| 6,026,592 | A | 2/2000 | Herr | |
| 6,488,155 | B2 | 12/2002 | Lawandy et al. | |
| 7,200,511 | B2 | 4/2007 | Damrath | |
| 7,363,780 | B2 | 4/2008 | Lee et al. | |
| 7,591,038 | B2 | 9/2009 | Murray et al. | |
| 7,765,715 | B2 | 8/2010 | Kim | |
| 8,528,229 | B2 * | 9/2013 | Ashrafzadeh | D06F 58/30 116/213 |
| 2001/0049846 | A1 | 12/2001 | Guzzi et al. | |
| 2002/0118366 | A1 | 8/2002 | Baldwin | |
| 2003/0034443 | A1 | 2/2003 | Kouznetsov et al. | |
| 2004/0249843 | A1 * | 12/2004 | Damrath | G06K 9/00 |
| 2005/0004956 | A1 | 1/2005 | Pourdeyhimi | |
| 2005/0016013 | A1 | 1/2005 | Bang et al. | |
| 2005/0097773 | A1 | 5/2005 | Gardner | |
| 2005/0196046 | A1 | 9/2005 | Hudnut et al. | |
| 2006/0243931 | A1 | 11/2006 | Haran et al. | |
| 2006/0255300 | A1 | 11/2006 | Shakespeare | |
| 2007/0272272 | A1 | 11/2007 | Choi et al. | |
| 2008/0013818 | A1 | 1/2008 | Shakespeare | |
| 2008/0072448 | A1 | 3/2008 | Hubig et al. | |
| 2008/0276964 | A1 | 11/2008 | Hendrickson et al. | |
| 2009/0177323 | A1 | 7/2009 | Ziegler et al. | |
| 2010/0115785 | A1 | 5/2010 | Ben-Shmuel et al. | |
| 2011/0067186 | A1 * | 3/2011 | Johansson | D06F 58/52 8/137 |

FOREIGN PATENT DOCUMENTS

| | | | |
|---|---|---|---|
| DE | 10156157 | A1 | 5/2003 |
| DE | 10302866 | A1 | 8/2004 |
| DE | 102005055411 | A1 | 5/2007 |
| EP | 0544945 | A1 | 6/1993 |
| FR | 2894996 | A1 | 6/2007 |
| JP | 04012799 | A | 1/1992 |
| JP | 4244193 | A | 9/1992 |
| JP | H11188198 | * | 12/1997 |
| JP | 10-277292 | A | 10/1998 |
| JP | 2002224486 | A | 8/2002 |
| JP | 2007-221711 | A | 8/2007 |
| JP | 2008054960 | A | 3/2008 |
| WO | 89/04887 | A1 | 6/1989 |
| WO | 01/78573 | A2 | 10/2001 |
| WO | 2008/000812 | A1 | 1/2008 |

* cited by examiner

LAUNDRY TREATING APPLIANCE WITH IMAGING CONTROL

CROSS-REFERENCE TO RELATED APPLICATION

This application is a continuation of U.S. patent application Ser. No. 16/145,949, filed Sep. 28, 2018, now U.S. Pat. No. 10,829,886, issued Nov. 10, 2020, which is a continuation of U.S. patent application Ser. No. 15/046,033, filed Feb. 17, 2016, now U.S. Pat. No. 10,113,263, issued Oct. 30, 2018, which is a continuation of U.S. patent application Ser. No. 14/022,132, filed Sep. 9, 2013, now U.S. Pat. No. 9,279,213, issued Mar. 8, 2016, which is a continuation of U.S. patent application Ser. No. 12/388,605, filed Feb. 19, 2009, now U.S. Pat. No. 8,528,229, issued Sep. 10, 2013, all of which are incorporated herein by reference in their entirety.

BACKGROUND

Laundry treating appliances, such as clothes washers, clothes dryers, refreshers, and non-aqueous systems, may have a configuration based on a rotating drum that defines a treating chamber in which laundry items are placed for treating. The laundry treating appliance may have a controller that implements a number of pre-programmed cycles of operation. The user typically manually selects the cycle of operation from the given pre-programmed cycles. Each pre-programmed cycle may have any number of adjustable parameters, which may be input by the user or may be set by the controller. The controller may set the parameter according to default values, predetermined values, or responsive to conditions within the treating chamber.

BRIEF DESCRIPTION

In one aspect, the disclosure relates to a laundry treating appliance, comprising a laundry treating chamber, an imaging device operably coupled with at least a portion of the laundry treating chamber, the imaging device adapted to capture multiple images of at least a portion of the laundry treating chamber, the multiple images defining image data that is representative of laundry in the laundry treating chamber, the imaging device adapted to output the image data, and a controller operably coupled to the imaging device and adapted to receive the output, and determine a condition of the laundry based on the image data to define a determined condition.

DETAILED DESCRIPTION

Figure 1:
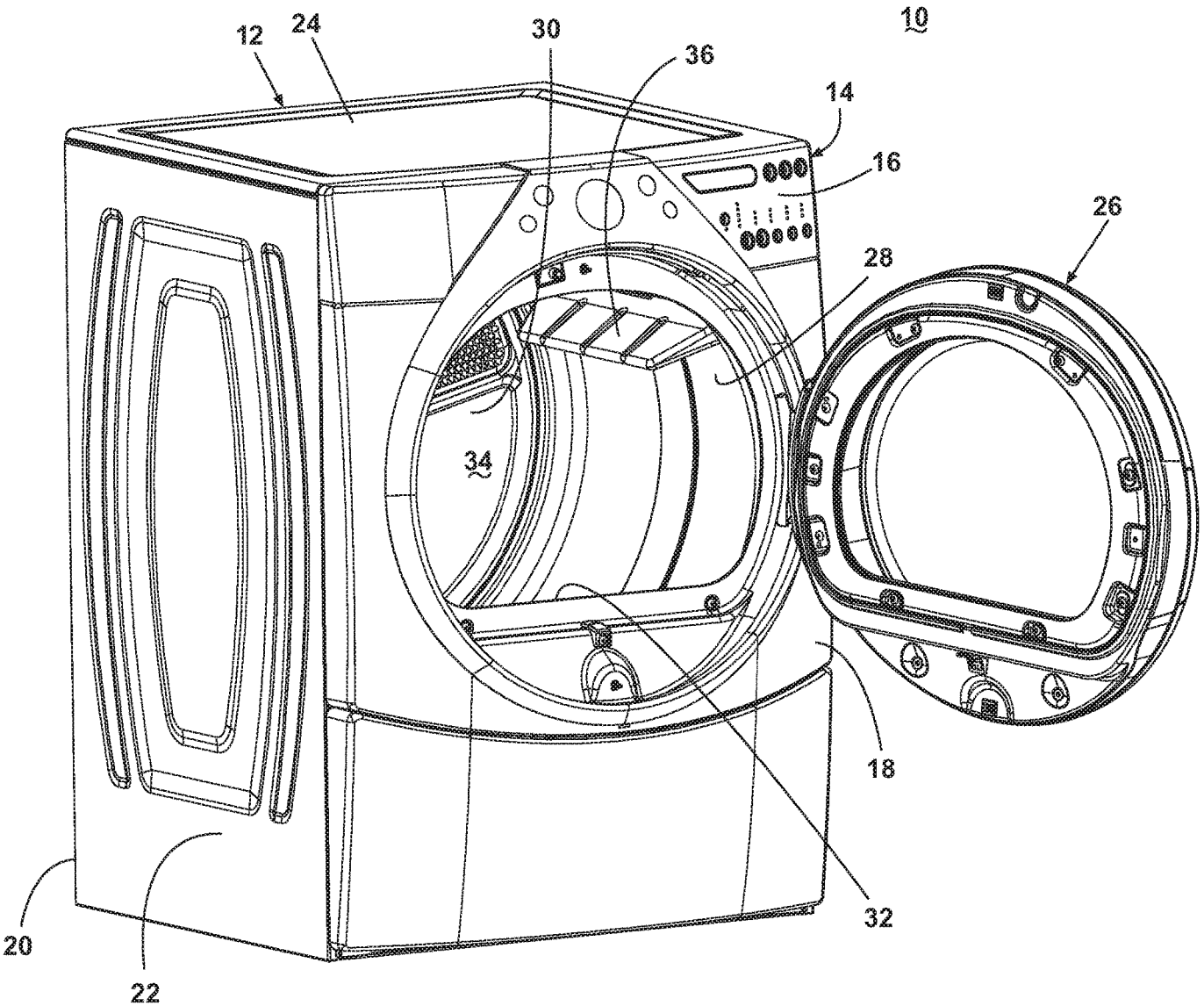
FIG. 1 is a front perspective view of a laundry treating appliance in the form of a clothes dryer with a treating chamber according to one embodiment of the invention.

FIG. 1 illustrates one embodiment of a laundry treating appliance in the form of a clothes dryer 10 according to the invention. While the laundry treating appliance is illustrated as a clothes dryer 10, the laundry treating appliance according to the invention may be any appliance which performs a cycle of operation on laundry, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet.

A rotatable drum 28 may be disposed within the interior of the cabinet 12 between opposing stationary rear and front bulkheads 30 and 32, which collectively define a treating chamber 34, for treating laundry, having an open face that may be selectively closed by the door 26. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

The drum 28 may include at least one lifter 36. In most dryers, there are multiple lifters. The lifters 36 may be located along the inner surface of the drum 28 defining an interior circumference of the drum 28. The lifters 36 may facilitate movement of the laundry within the drum 28 as the drum 28 rotates.

Figure 2:
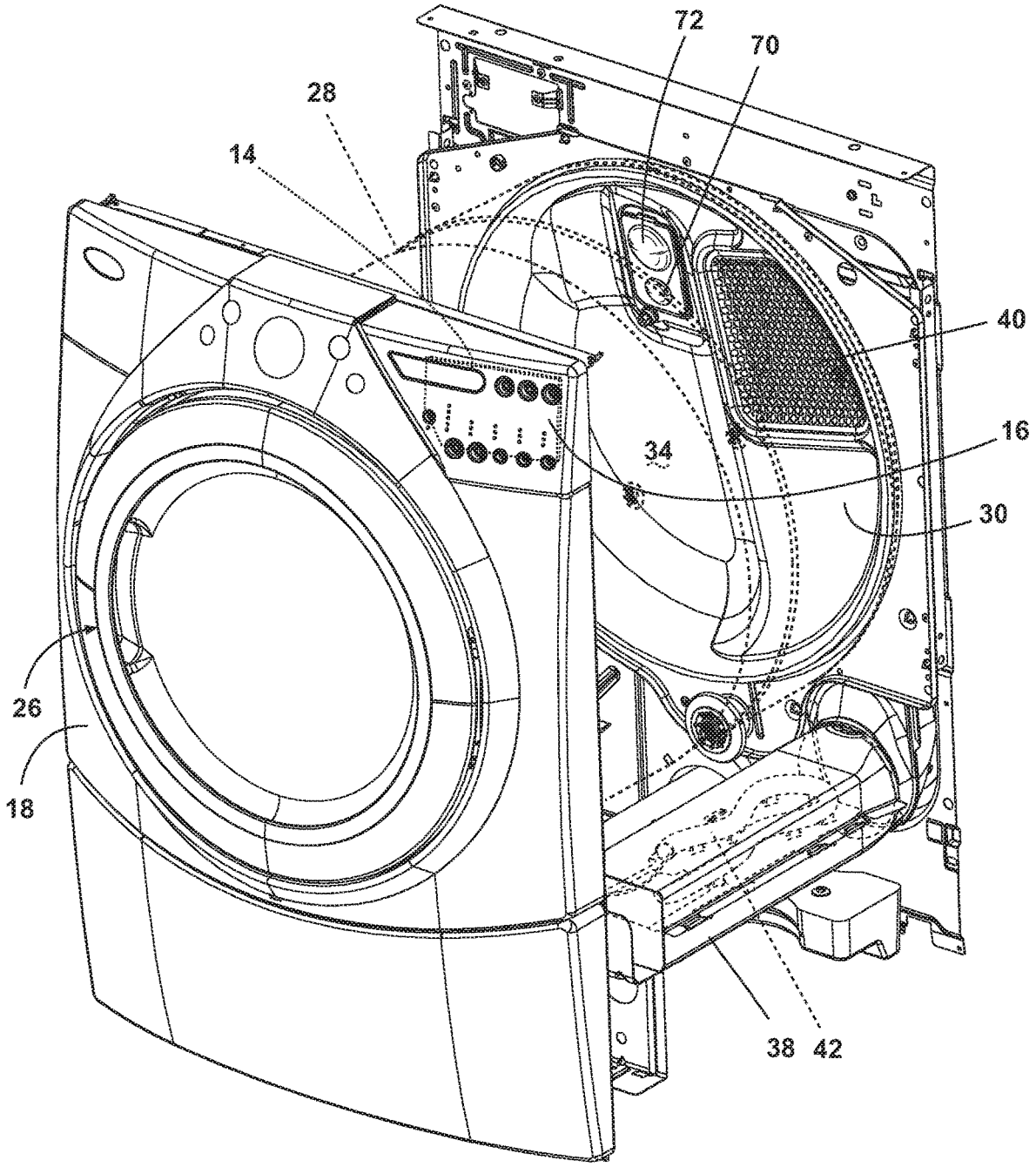
FIG. 2 is a partial perspective view of the dryer of FIG. 1 with portions of the cabinet removed for clarity according to one embodiment of the invention.

As illustrated in FIG. 2, the dryer 10 may also be provided with a light source 33 in either the rear or front bulkheads 30, 32 for illuminating the contents of the treating chamber 34.

Still referring to FIG. 2, an air flow system for the clothes dryer 10 according to one embodiment of the invention will now be described. The air flow system supplies air to the treating chamber 34 and then exhausts air from the treating chamber 34. The supplied air may be heated or not. The air flow system may have an air supply portion that may be formed in part by an inlet conduit 38, which has one end open to the ambient air and another end fluidly coupled to an inlet grill 40, which may be in fluid communication with the treating chamber 34. A heating element 42 may lie within the inlet conduit 38 and may be operably coupled to and controlled by the controller 14. If the heating element 42 is turned on, the supplied air will be heated prior to entering the drum 28.

Figure 3:
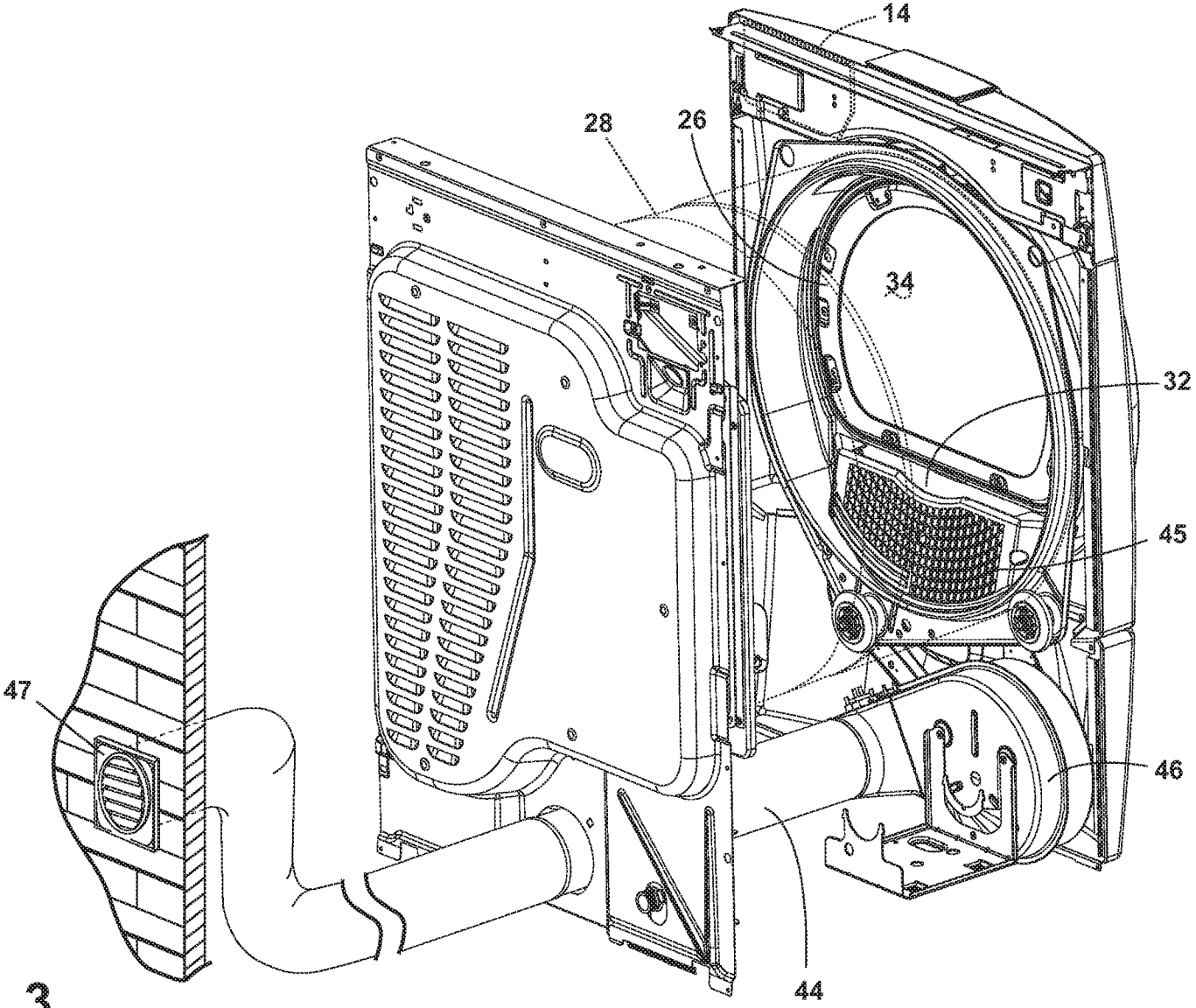
FIG. 3 is second partial perspective view of the dryer of FIG. 1 with portions of the cabinet removed for clarity according to one embodiment of the invention.

Referring to FIG. 3, the air supply system may further include an air exhaust portion that may be formed in part by an exhaust conduit 44 and lint trap 45, which are fluidly coupled by a blower 46. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct 47 or exhausting the air from the drying chamber to the outside.

Figure 4:
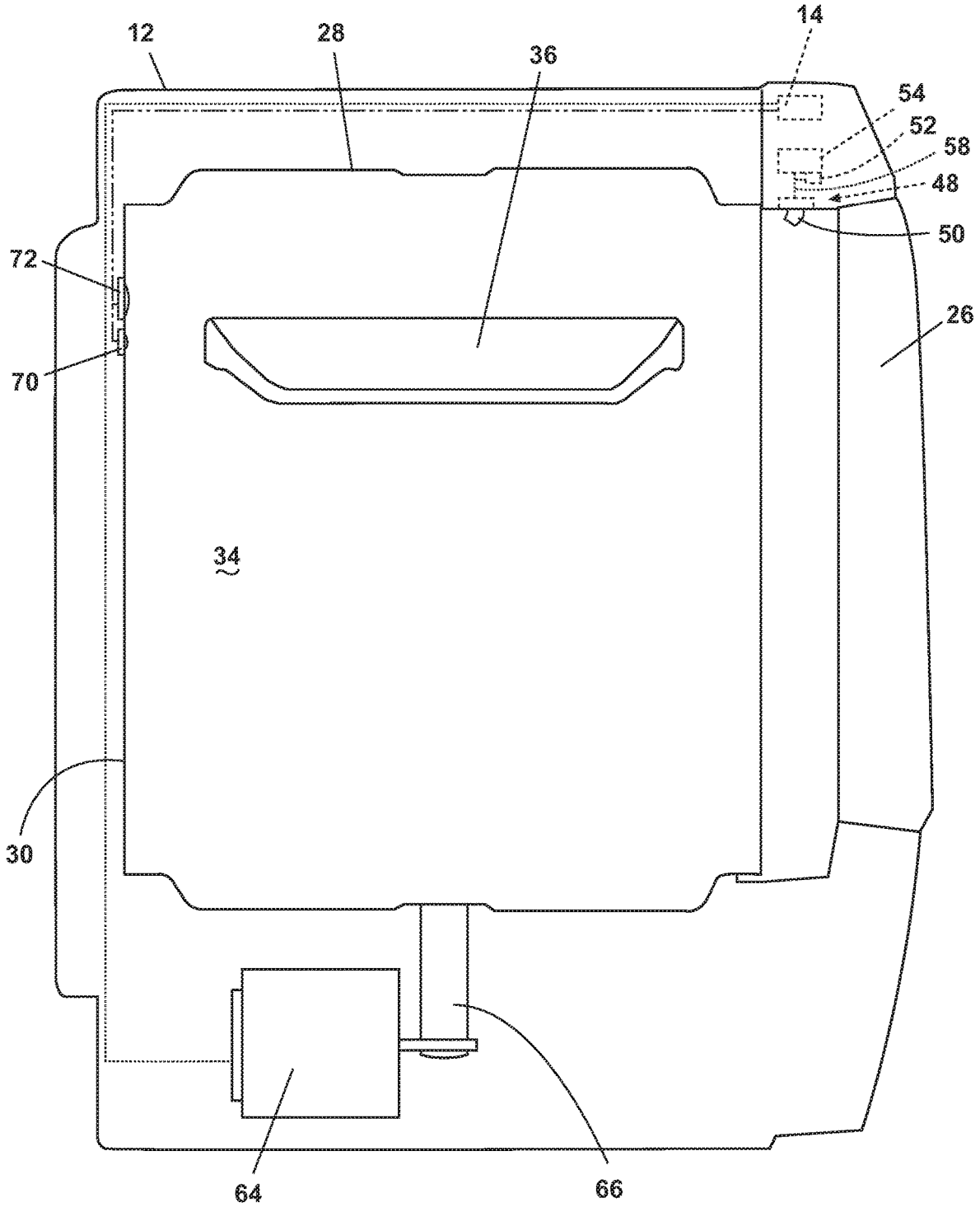
FIG. 4 is a schematic side view of the dryer of FIG. 1 having an imaging system for imaging the treating chamber according to one embodiment of the invention.

Referring now to FIG. 4, the clothes dryer 10 may optionally have a dispensing system 48 for dispensing treating chemistries, including without limitation water or steam, into the treating chamber 34, and thus may be considered to be a dispensing dryer. The dispensing system 48 may include a reservoir 54 capable of holding treating chemistry and a dispenser 50 that fluidly couples with the reservoir 54 through a dispensing line 58. The treating chemistry may be delivered to the dispenser 50 from the reservoir 54 and the dispenser 50 may dispense the chemistry into the treating chamber 34. The dispenser 50 may be positioned to direct the treating chemistry at the inner surface of the drum 28 so that laundry may contact and absorb the chemistry, or to dispense the chemistry directly onto the laundry in the treating chamber 34. The type of dispenser 50 is not germane to the invention. A chemistry meter 52 may electronically couple, wired or wirelessly, to the controller 14 to control the amount of treating chemistry dispensed.

As is typical in a clothes dryer, the drum 28 may be rotated by a suitable drive mechanism, which is illustrated as a motor 64 and a coupled belt 66. The motor 64 may be operably coupled to the controller 14 to control the rotation of the drum 28 to complete a cycle of operation. Other drive mechanisms, such as direct drive, may also be used.

The clothes dryer 10 may also have an imaging device 70 to image the treating chamber 34 and/or anything within the treating chamber 34. Exemplary imaging devices 70 may include any optical sensor capable of capturing still or moving images, such as a camera. One suitable type of camera is a CMOS camera. Other exemplary imaging devices include a CCD camera, a digital camera, a video camera or any other type of device capable of capturing an image. That camera may capture either or both visible and non-visible radiation. For example, the camera may capture an image using visible light. In another example, the camera may capture an image using non-visible light, such as ultraviolet light. In yet another example, the camera may be a thermal imaging device capable of detecting radiation in the infrared region of the electromagnetic spectrum. The imaging device 70 may be located on either of the rear or front bulkhead 30, 32 or in the door 26. It may be readily understood that the location of the imaging device 70 may be in numerous other locations depending on the particular structure of the dryer and the desired position for obtaining an image. There may also be multiple imaging devices, which may image the same or different areas of the treating chamber 34.

The clothes dryer 10 may also have an illumination source 72. The type of illumination source 72 may vary. In one configuration, the illumination source 72 may be a typical incandescent dryer light which is commonly used to illuminate the treating chamber 34. Alternatively, one or more LED lights may be used in place of an incandescent bulb. The illumination source 72 may also be located behind the rear bulkhead 30 of the drum 28 such that the light shines through the holes of the air inlet grill 40. It is also within the scope of the invention for the clothes dryer 10 to have more than one illumination source 72. For example, an array of LED lights may be placed at multiple positions in either bulkhead 30, 32.

The illumination source 72 may be located on the same side of the drum 28 as the imaging device 70, as illustrated in FIG. 4, or located on a different side of the drum 28. When the illumination source 72 is located on the same side of the drum 28 as the imaging device 70, the imaging device 70 may detect the light that may be reflected by the drum 28 and the laundry load. Image analysis may then be used to separate the drum 28 from the laundry load. When the illumination source 72 is located on a side of the drum 28 opposite the imaging device 70, the imaging device 70 detects only the light from the illumination source 72 that is not blocked by the laundry load. At any instant in time, a given location in an image will be dark or light depending on whether or not laundry is present at that location.

The illumination generated by the illumination source 72 may vary, and may well be dependent on the type of imaging device 70. For example, illumination may be infrared if the imaging device 70 is configured to image in the infrared spectrum. Similarly, the illumination may be visible light, if the imaging device 70 is configured to image the visible spectrum.

Figure 5:
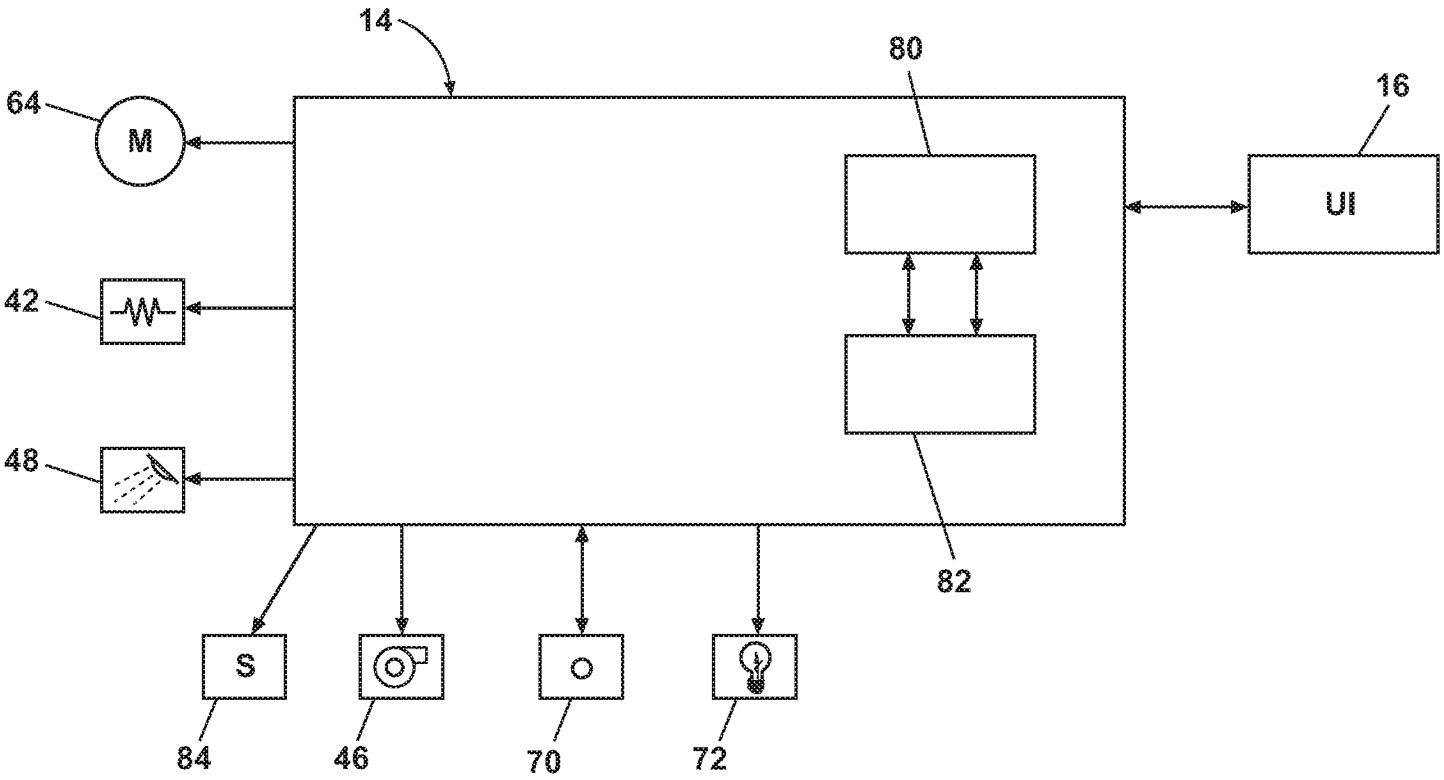
FIG. 5 is a schematic representation of a controller for controlling the operation of one or more components of the clothes dryer of FIG. 1 according to one embodiment of the invention.

As illustrated in FIG. 5, the controller 14 may be provided with a memory 80 and a central processing unit (CPU) 82. The memory 80 may be used for storing the control software that may be executed by the CPU 82 in completing a cycle of operation using the clothes dryer 10 and any additional software. The memory 80 may also be used to store information, such as a database or table, and to store data received from the one or more components of the clothes dryer 10 that may be communicably coupled with the controller 14.

The controller 14 may be communicably and/or operably coupled with one or more components of the clothes dryer 10 for communicating with and controlling the operation of the component to complete a cycle of operation. For example, the controller 14 may be coupled with the heating element 42 and the blower 46 for controlling the temperature and flow rate through the treatment chamber 34; the motor 64 for controlling the direction and speed of rotation of the drum 28; and the dispensing system 48 for dispensing a treatment chemistry during a cycle of operation. The controller 14 may also be coupled with the user interface 16 for receiving user selected inputs and communicating information to the user.

The controller 14 may also receive input from various sensors 84, which are known in the art and not shown for simplicity. Non-limiting examples of sensors 84 that may be communicably coupled with the controller 14 include: a treating chamber temperature sensor, an inlet air temperature sensor, an exhaust air temperature sensor, a moisture sensor, an air flow rate sensor, a weight sensor, and a motor torque sensor.

The controller 14 may also be coupled with the imaging device 70 and illumination source 72 to capture one or more images of the treating chamber 34. The captured images may be sent to the controller 14 and analyzed using analysis software stored in the controller memory 80 to determine a motion condition of the laundry. The controller 14 may use the determined motion condition to set one or more operating parameters of at least one component with which the controller 14 is operably coupled with to complete a cycle of operation. The determined motion condition of the laundry may include at least one of tumbling, rolling (also called balling), sliding, satelliting (also called plastering) and any combination thereof.

The terms tumbling, rolling, sliding and satelliting are terms of art that may be used to describe the motion of some or all of the items forming the laundry load. However, not all of the items forming the laundry load need exhibit the motion for the laundry load to be described accordingly.

A brief description of each motion will be useful in understanding the term. Tumbling is a condition in which the laundry may be lifted by the rotating drum from a lower position, generally near or at the bottom of the drum, to a raised position, above the lower position, where the laundry is no longer being lifted by the drum and falls within the drum, generally toward the bottom of the drum. While falling, the laundry may be exposed to any drying air and/or treatment within the drum. The falling may spread out the laundry, increasing its effective surface area, to expose a greater portion of the laundry to any drying air and/or treatment being applied. This phenomenon may increase the rate at which the laundry dries and maximize the interaction between the laundry and the treatment. Examples of treatments that may be applied include steam, mist or a chemistry treatment.

Rolling is a condition in which the laundry may not be lifted by the drum as the drum rotates, such as occurs during tumbling, but rolls or rotates while part of the laundry may still be in contact with the drum lifter. In this condition, a frictional force may be present that causes the laundry to move in a rolling or folding manner with little or no motion above its horizontal position in the drum. Rolling may occur with laundry items that are too large or heavy to be lifted by the drum or when a laundry item becomes entangled with another item. Because the laundry remains concentrated near the bottom of the drum, exposure of the laundry to the drying air and/or treatment may be minimized. This may result in incomplete drying of the laundry and non-uniform application of the treatment.

Sliding is another condition in which the laundry may not be lifted by the drum as the drum rotates, such as occurs during tumbling, but may remain at or near the bottom of the drum. Sliding differs from rolling in that the laundry does not move in a rolling or folding manner, rather, it slides off the inner surface of the drum as the drum rotates, generally exposing the same face of the laundry to the drying air and/or treatment. This may result in incomplete drying of the laundry and non-uniform application of the treatment.

Satelliting is a condition in which the laundry may be held by centrifugal force against the inner surface of the drum as the drum rotates. When satelliting occurs in a clothes dryer, exposure of the laundry to the drying air and/or treatment may be minimized, because the laundry remains at a fixed location relative to the drum, which may result in incomplete drying of the laundry and non-uniform application of the treatment.

The previously described clothes dryer 10 provides the structure necessary for the implementation of the method of the invention. Several embodiments of the method will now be described in terms of the operation of the clothes dryer 10. The embodiments of the method function to automatically determine the motion state of the laundry and control the operation of the clothes dryer 10 based on the determined motion state.

The motion state of the laundry may be determined by using the imaging device 70 to obtain one or more images over time of the contents of the drum 28 as it is rotating. For some motion states, a single image may be all that needs to be analyzed. For other motion states, multiple images over time may need to be analyzed. The motion state of the laundry may then be used to control the operation of the clothes dryer 10.

Controlling the operation of the clothes dryer 10 based on the determined motion state may include setting at least one parameter of a cycle of operation including a rotational speed of the drum 28, a direction of rotation of the drum 28, a temperature in the treating chamber 34, an air flow through the treating chamber 34, a type of treating chemistry, an amount of treating chemistry, a start or end of cycle condition and a start or end cycle step condition.

Setting a start or end of cycle condition may include determining when to start or end a cycle of operation. This may include signaling the controller 14 to immediately start or end a cycle of operation or setting a time at which to start or end a cycle of operation.

Setting a start or end of cycle step condition may include determining when to start a step or phase within a given operating cycle or when to end a step within a given operating cycle. This may include signaling the controller 14 to immediately transition from one cycle step to another or setting a time at which to transition from one step to another within a given operating cycle. Examples of cycle steps include rotation with heated air, rotation without heated air, treatment dispensing and a wrinkle guard step.

For laundry treating appliances other than clothes dryers, parameters of a cycle of operation that may be set based on the determined motion state may also include a rotational speed of an agitator, a direction of agitator rotation, and a wash liquid fill level.

Figure 6:
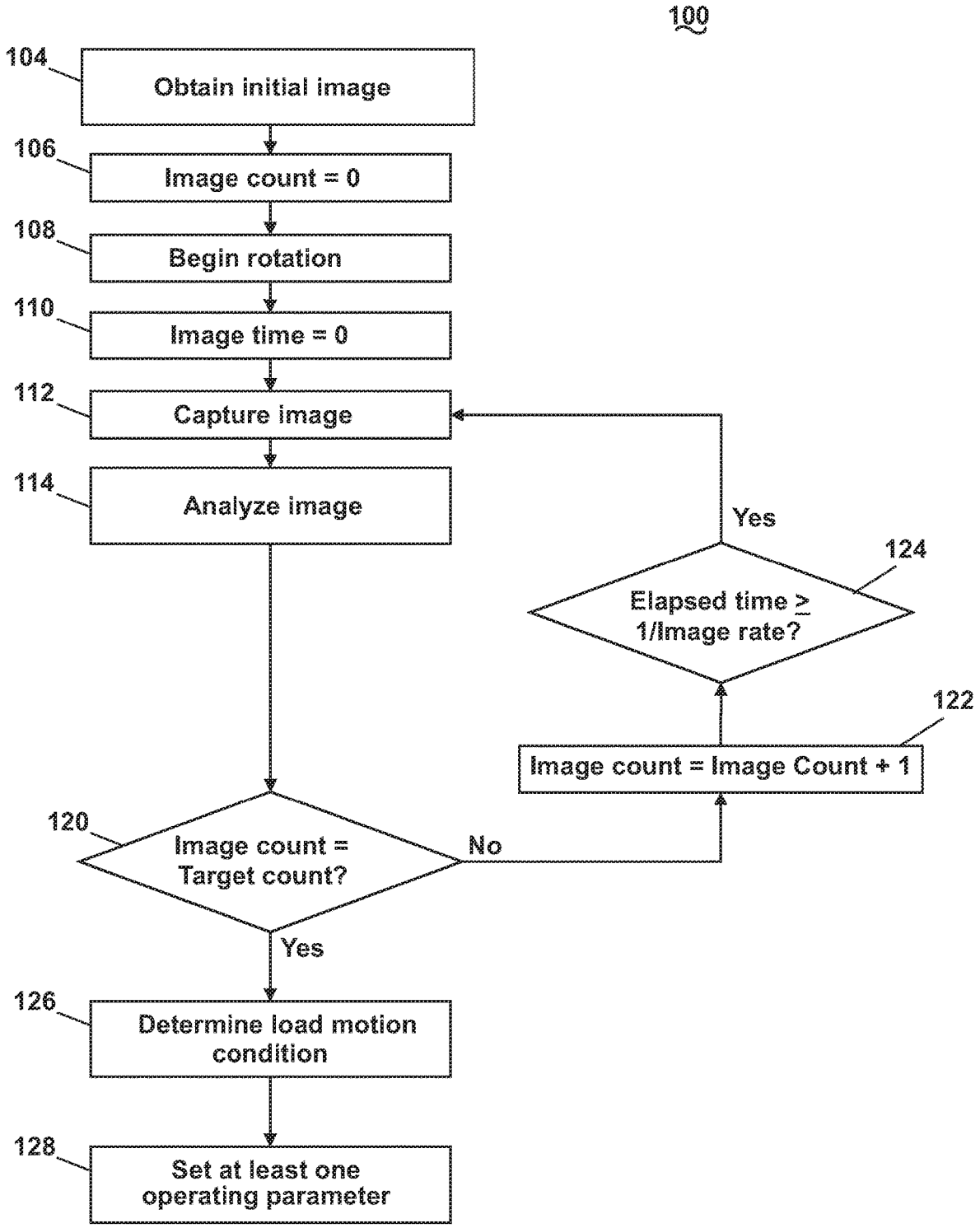
FIG. 6 is a flow chart illustrating a method for capturing and analyzing images of the treating chamber according to a second embodiment of the invention.

Referring to FIG. 6, a flow chart of one method 100 of determining the motion of a load of laundry is shown in accordance with the present invention. The motion determining method 100 may be executed by the controller 14 during a drying or treatment cycle of the clothes dryer 10. The sequence of steps depicted is for illustrative purposes only, and is not meant to limit the motion determining method 100 in any way as it is understood that the steps may proceed in a different logical order or additional or intervening steps may be included without detracting from the invention.

The method 100 starts with assuming that the user has loaded the clothes dryer 10 with one or more articles to form the laundry load and closed the door 26. The method 100 may be initiated automatically when the user closes the door 26 or at the start of a user selected operating cycle. Step 104 is an optional step in which the controller 14 obtains an initial image of the laundry load without rotation of the drum. While not germane to this invention, the initial image may be used to determine load parameters such as the volume of the load or fabric type of the load, for example.

In the next step 106, a counter Image Count is set to 0 and rotation of the drum 28 is initiated at 108. The speed of rotation of the drum 28 may be increased until it reaches a predetermined speed of rotation. The predetermined speed of rotation may be determined by the controller 14 based on the selected operating cycle and the operating parameter settings. When the drum speed reaches the predetermined speed, the image time may be set to 0 at step 110 and the imaging device 70 may capture an image of all or some portion of the treating chamber 34. The captured image may be sent to the controller 14 for image analysis using software that is stored in the memory 80 of the controller 14.

It is also within the scope of the invention for the imaging device 70 to have a memory and a microprocessor for storing information and software and executing the software, respectively. In this manner, the imaging device 70 may analyze the captured image data and communicate the results of the analysis with the controller 14.

In step 114, analyzing the image may include separating the load image from the background, i.e. the dryer drum 28, in the image captured in step 112. Any suitable method may be used to separate the load from the background in the image. There are several methods for separating the load image from the background depending on the illumination configuration, drum properties and the load. Once the load image is separated from the background, an image of the treating chamber 34 may be created wherein each pixel in the image indicates the presence or absence of the load. The image separation techniques may also be used to separate one load item from another.

For example, in the case of an illumination configuration where the illumination source 72 may be located on the same side of the drum 28 as the imaging device 70, techniques such as edge detection, color segmentation and deviation from a known background image may be used to separate the load from the background. Edge detection may be calculated using known methods. Color segmentation involves separating the individual items in a load from each other and separating the load from the background based on differences in the saturation, hue and luminance of objects in the image. The surface of the dryer drum 28 may also contain optically detectable features to aid in the separation of the load from the background image of the drum 28.

In the case of an illumination configuration in which the load may be back lit from an illumination source 72 located on a portion of the drum 28 opposite from the imaging device 70, separation of the load from the background may be more simplified. The areas in which a load is present will appear black or dark in the image, since light from the illumination source 72 is blocked by the load. In places where the load is not present, the light from the illumination source may be detected by the imaging device 70.

Regardless of how the load image is separated from the background in step 114, the images captured by the imaging device 70 may be used to obtain information relating to the shape and location of the laundry load relative to the drum 28. For example, the image may be used to calculate the area, perimeter, center of mass, radius and major or minor axis of the load using known methods. The image may also be used to determine the motion of the load relative the drum 28. One method for determining the position or motion of the load is to build a segmentation map from the captured image of the treating chamber 34.

A segmentation map may be created by dividing the image space into fixed segments and then determining the fraction of the area of each segment in which the load is present. The load position at any instant in time may be characterized by the percent coverage of the load in each segment. The percent coverage is the percentage of pixels in the image where the load is present. The position of the load at a given instant in time may be determined by the percent coverage in each segment at that instant in time. The motion of the load may be determined by integrating the percent coverage over multiple revolutions of the drum 28.

The segmentation map created in step 114 may be stored in the memory associated with the imaging device 70 or with the controller 14. The stored segmentation maps may be used to create a database from which a load motion segmentation map may be determined by integrating the percent coverage of each segment over time as described above.

In the next step 120, the controller 14 determines if the image count equals the target count. If the image count is less than the target count, the image count may be increased by 1 in step 122. If the elapsed time in step 124 is determined to be equal to or greater than one divided by the imaging rate, the method returns to step 112 and steps 112 through 120 may be repeated.

The target image count in step 120 may be selected such that a sufficient number of images may be captured and analyzed to determine the motion condition of the load. The image rate may be selected such that a predetermined number of images may be captured within a predetermined amount of time. The predetermined amount of time for capturing images for analysis may be set such that the motion condition may be determined and corrected, if necessary, within a suitable amount of time to avoid or minimize undesirable conditions such as sliding, rolling and satelliting of the load.

If the image count equals the target count, then the load motion condition may be determined in step 126 by integrating the percent coverage in each segment of each segmentation map created in step 114 from the images treating chamber 34. The integrated percent coverage in each segment may be used to create an integrated segmentation map wherein the value in each segment correlates to the amount of time laundry is present in that segment. The determined integration segmentation map may be analyzed using pattern recognition techniques to determine if the segmentation map corresponds to a known motion condition. Pattern recognition may be used to determine if all of the load or some part of the load is exhibiting a motion state consistent with a known condition.

In step 128, the determined load motion condition may be used by the controller 14 to set one or more parameters of a cycle of operation including a rotational speed of the drum 28, a direction of rotation of the drum 28, a temperature in the treating chamber 34, an air flow through the treating chamber 34, a type of treating chemistry, an amount of treating chemistry, a start or end of cycle condition and a start or end cycle step condition.

In addition to setting one or more parameters of a cycle of operation based on the determined load motion condition, the controller 14 may also use information received from one or more sensors 84. For example, the controller 14 may use information relating to the motor torque to estimate the size of the load and set one or more operating parameters based on the estimated load size and the determined load motion condition.

Figure 7:
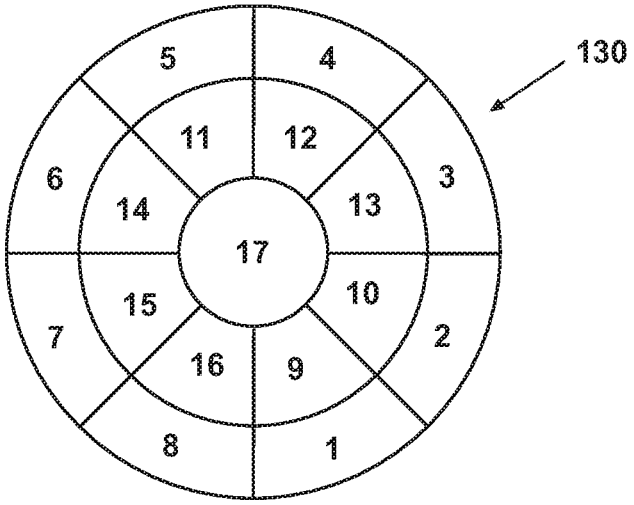
FIG. 7 is a schematic representation of a grid for analyzing an image of the treating chamber according to the second embodiment of the invention.

FIG. 7 illustrates an example of a segmentation map 130 for a horizontal axis dryer 10 with the imaging device 70 located near the horizontal axis of the drum 28 on the rear bulkhead 30, as illustrated in FIG. 4. As illustrated in FIG. 7, the image of the treating chamber 34 may be divided into 17 segments extending from the periphery of the drum 28 into the center of the treating chamber 34. The location, number, shape and size of the segments may vary depending on a variety of factors, including, without limitation, the motion condition(s) being monitored, the shape of the drum 28 and the location of the imaging device 70. While the grid 130 is illustrated having a generally circular shape, the captured image and applied grid are not limited to any regular or irregular shape.

Figure 8:
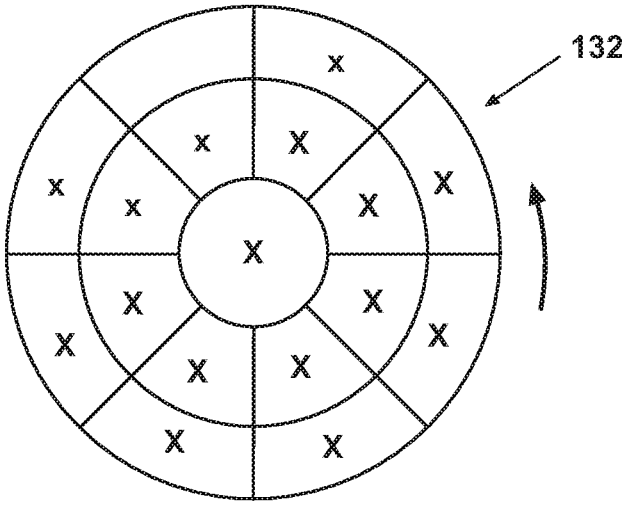
FIG. 8 is a schematic representation of an image of the treating chamber illustrating a tumbling motion condition according to the second embodiment of the invention.

FIG. 8 illustrates an example of an integrated segmentation map 132 for a clothes dryer 10 having a drum 28 rotating counter clockwise wherein the load is exhibiting a tumbling condition. The segmentation map 132 may be created by integrating the percent coverage in each segment of the image over time. The "x" in each segment symbolizes the percent coverage of the load in each segment; the larger and more numerous the "x", the larger the percent coverage. The "x" is used for visual understanding. However, in practice, the "x" may be a numerical value stored in the memory 80 of the controller 14, with the magnitude of the numerical value indicating the percentage coverage in the corresponding segment.

As may be seen in the integrated segmentation map 132, the load is spending most of its time at the bottom of the drum 28, the middle of the treating chamber 34 and partly up the right side of the drum 28. This percent coverage pattern is consistent with a tumbling condition for a drum 28 rotating counter clockwise, wherein the load may be lifted into the air by the rotation of the drum 28 and then falls back to the bottom of the drum 28.

Figure 9:
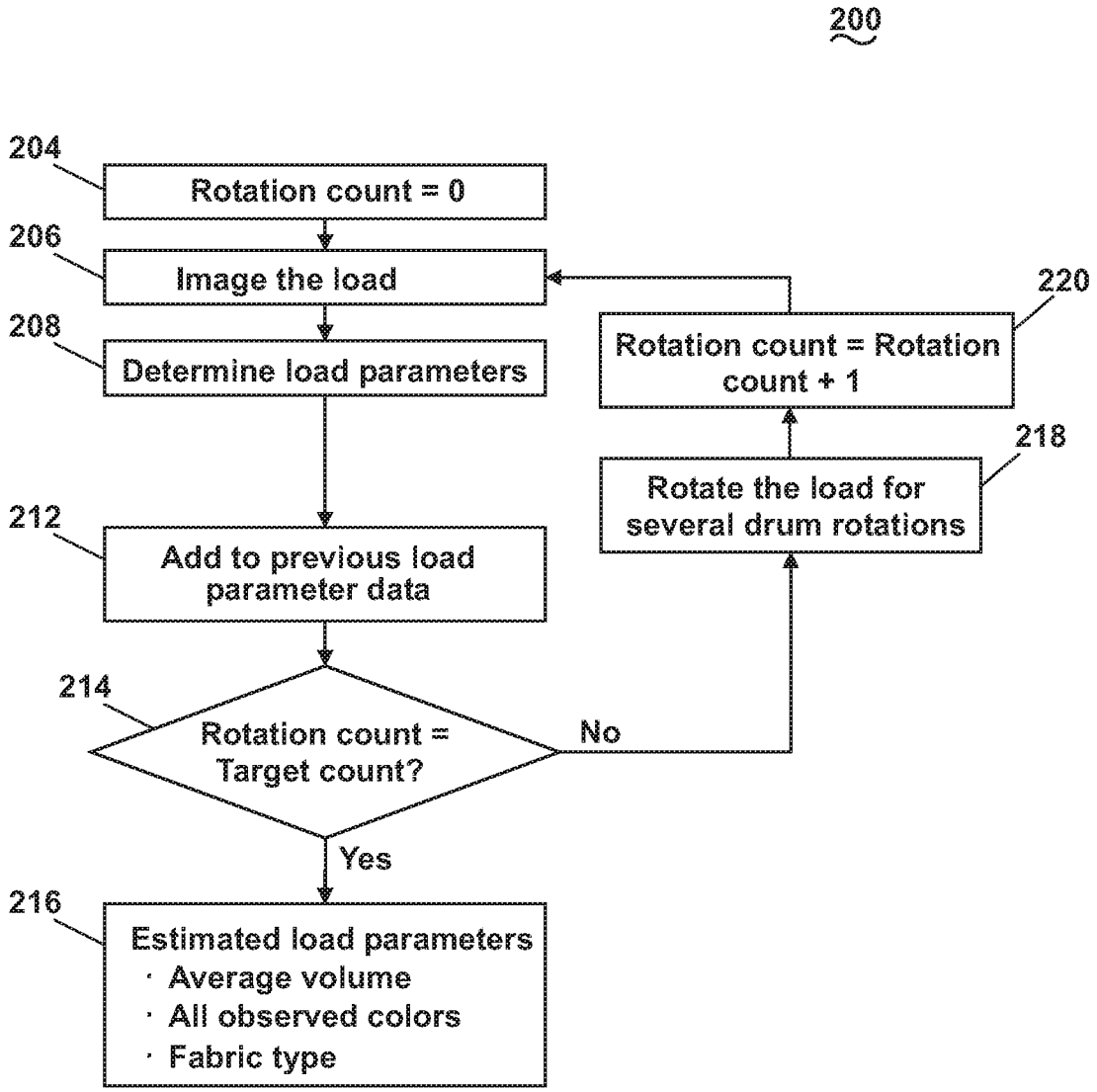
FIG. 9 is a flow chart illustrating a method for capturing an image of the treating chamber and estimating load parameters based on the captured image according to a third embodiment of the invention.

FIG. 9 illustrates a method 200 for obtaining the initial image data in step 104 of method 100. The initial image is an optional step and may be used by the controller 14 to determine parameters of the load such as the size or fabric type of the load. The initial imaging method 200 may be executed by the controller 14 prior to the start of a drying or treatment cycle of the clothes dryer 10.

The method 200 starts with assuming that the user has loaded the clothes dryer 10 with one or more articles to form the laundry load and closed the door 26. The method 200 may be initiated automatically when the user closes the door 26 or at the start of a user selected operating cycle. The controller 14 first sets a counter Rotation Count to 0 in step 204.

In the next step 206, the controller 14 may capture an image of the load to determine the load parameters for completing the cycle of operation. The load parameters may be determined in step 208 and combined with load parameters previously determined from the image data or determined elsewhere in step 212. For example, the cycle and parameter settings selected by the user through the user interface 16 may be combined with the parameters determined from the image data.

In the next step 214, the controller 14 may determine if the rotation count has reached the target count. If it has not reached the target rotation count, then the drum 28 may be rotated one or more times and the rotation count is increased by 1 in steps 218 and 220. The method 200 then starts again at step 206 and repeats steps 206 through 214 until the rotation count equals the target count in step 214.

Once the rotation count reaches the target count in step 214, the controller may estimate the load parameters for completing a cycle of operation in step 216. Examples of load parameters that may be estimated using method 200 include the size of the load, fabric type and the color of the load.

Figure 10:
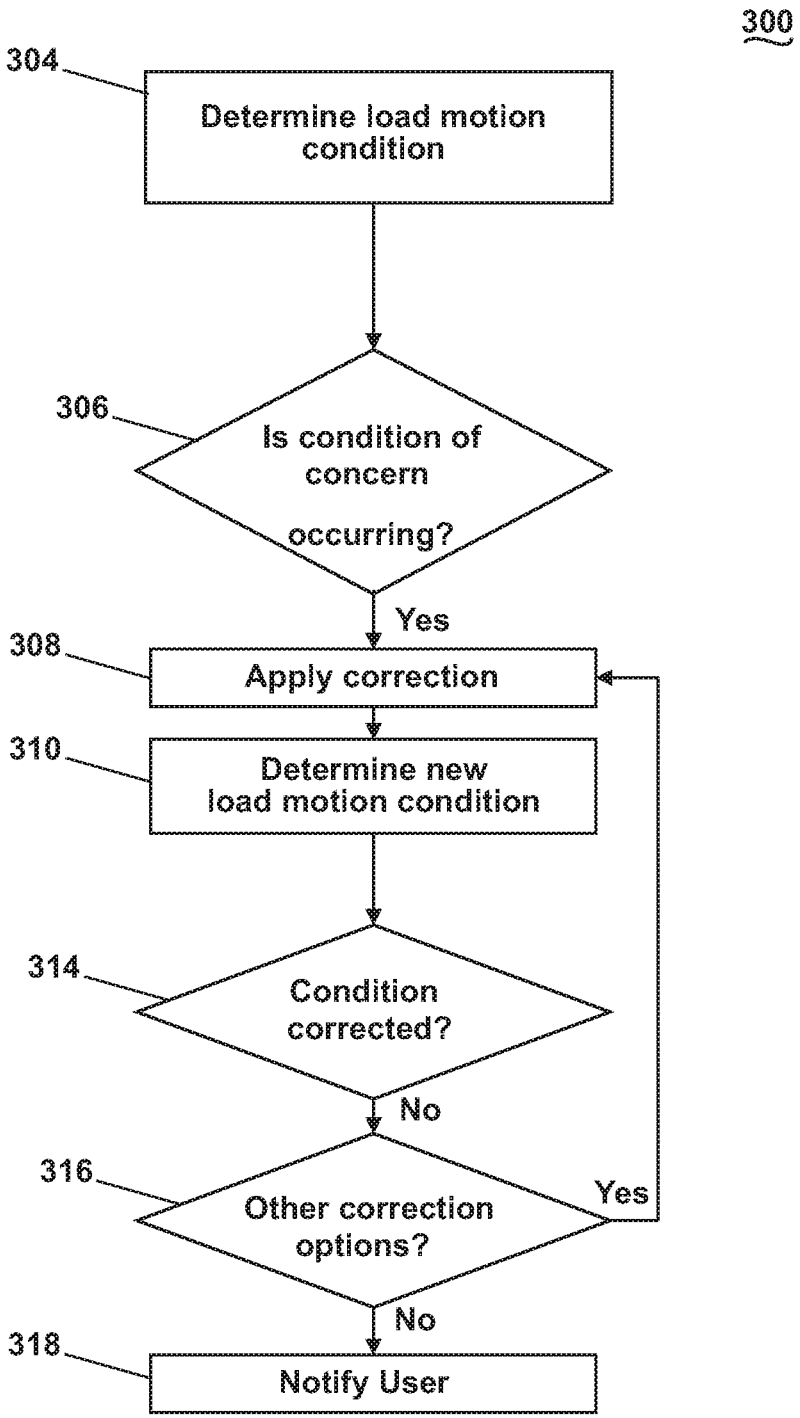
FIG. 10 is a flow chart illustrating a method for determining if a condition of concern exists in the treating chamber and applying a corrective action according to a fourth embodiment of the invention.

FIG. 10 illustrates a method 300 for automatically determining the motion state of the laundry and controlling the operation of the clothes dryer 10 based on the determined motion state. The load motion condition may be determined in step 304 according to steps 104 through 126 of the method 100 or based on another method.

The determined load motion condition may be analyzed to determine if it corresponds to a condition of concern in step 306. This determination may include taking into account other load conditions, such as the fabric type and load size, which may be determined using the method 200 or based on sensor readings from one or more sensors 84 associated with the dryer 10.

If the motion state indicates a condition of concern in step 306, the controller 14 may control the operation of the clothes dryer 10 depending on the determined condition to apply one or more corrective actions. The control of the clothes dryer 10 may include setting at least one operating parameter of a cycle of operation including a rotational speed of the drum 28, a direction of rotation of the drum 28, a temperature in the treating chamber 34, an air flow through the treating chamber 34, a type of treating chemistry, an amount of treating chemistry, a start or end of cycle condition and a start or end cycle step condition.

In step 306, a condition of concern that requires corrective action may be based on determining an absolute or relative amount of the laundry load that is exhibiting a particular motion condition. This may include determining that a motion condition, such as sliding, rolling or satelliting, requires corrective action when any part of the laundry is exhibiting the condition. Alternatively, it may be determined in step 306 that a condition of concern exists only if all of the load is exhibiting the condition.

A predetermined threshold may also be set for a given motion condition wherein if it is determined that some part of the laundry load above the threshold is exhibiting a condition of concern, corrective action is taken. The threshold for determining when a motion condition requires corrective action may vary depending on the size and fabric type of the load, the determined motion condition, the cycle and one or more operating parameters of the cycle.

Once it is determined that a condition of concern requiring corrective action is occurring, a corrective action may be applied to the clothes dryer 10 in step 308. A new load motion condition may be determined in step 310 to determine if the corrective action applied in step 308 had its intended effect. The new load motion condition may be determined in a manner similar to step 304 to determine whether or not the condition was corrected and a condition of concern requiring corrective action is no longer taking place.

If it is determined in step 314 that the condition was not corrected, the controller 14 may determine if other correction options are available and one or more of these options may be applied in step 308 and the process may be repeated until the condition is corrected. If it is determined in step 316 that no other correction options are available, the controller 14 may stop the operating cycle and notify the user using an audible signal or a visual signal through the user interface 16.

Alternatively, the controller 14 may implement corrective actions until the condition is reduced to within an acceptable range. If the condition cannot be corrected or reduced to within an acceptable range, the controller 14 may notify the user of a condition requiring attention through an audible or visual signal, such as an indicator light on the user interface 16, for example. The controller 14 may move to step 318 in the method 300 if all of the pre-determined corrective actions for a given condition have been tried, after a pre-determined number of corrective actions have been tried or after a pre-determined amount of time has elapsed since the condition of concern was identified in step 306.

One example of a condition of concern that may be determined using the imaging device 70 is satelliting of the load. Satelliting may often occur when small loads are placed in the treating chamber 34. When satelliting occurs, some or all of the items of the load do not tumble, but adhere to the wall of the drum 28 or the lifters 36. As a result of satelliting, the items of the load may not interact with the air applied for drying the load or any other treatment such as a chemical or steam treatment. This may lead to incomplete and/or inconsistent drying of the load or non-uniform application of the treatment.

Figure 11:
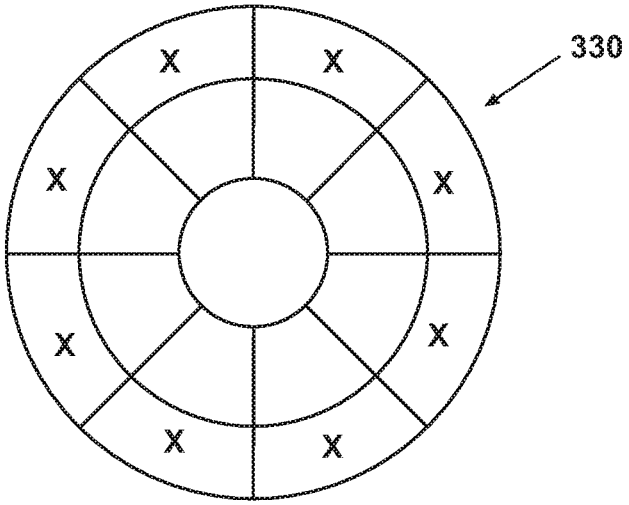
FIG. 11 is a schematic representation of an image of the treating chamber illustrating a satelliting motion condition according to a fifth embodiment of the invention.

FIG. 11 illustrates an example of an integrated segmentation map 330 for a small load that may be determined using steps 104 through 126 of the method 100 illustrated in FIG. 6. The segmentation map 330 may be utilized according to the method 300 to determine if a condition of concern is occurring and appropriate corrective measures may be applied as illustrated in FIG. 10. The "x" in each segment symbolizes the integrated percent coverage of the load in each segment over time; the larger the "x", the larger the percent coverage. As may be seen in FIG. 11, the load is mostly located in the outer segments around the periphery of the drum 28, consistent with satelliting of the load.

While the map 330 illustrates a satelliting condition in which all of the load is plastered against the periphery of the drum 28, a range of satelliting conditions may exist ranging from a single item in the load to the entire load. For example, a single item in the load may be experiencing a satelliting condition while the remainder of the load is experiencing some other condition, such as tumbling, that may or may not require corrective action.

Alternatively, it may be determined that some relative amount of the laundry load is satelliting, for example, 15% of the load, while the remaining 85% of the load is experiencing a different motion condition. The threshold for determining the absolute or relative amount of satelliting that requires a corrective action may vary depending on the determined condition, the size and type of the load, the cycle and one or more operating parameters of the cycle.

As illustrated in method 300, the controller 14 may control the operation of the clothes dryer 10 to affect one or more corrective actions in step 308 consistent with the determined satelliting condition. Examples of corrective action that may be taken to correct a satelliting condition include: slowing down the rotational speed of the drum 28; stopping the rotation of the drum 28 and restarting the rotation in a reverse direction; stopping the rotation of the drum 28 and restarting the rotation in the same direction. The controller 14 may implement successive corrective actions until the condition is corrected or may notify the user if the condition cannot be corrected.

Another example of a condition of concern is rolling of the load. Rolling is a condition that may occur with large loads, such as bed sheets or blankets. Rolling is a condition in which the load is not lifted and tumbled by the rotation of the drum 28, but rather the load stays near the bottom of the drum 28. Rolling may result in the load not being dried completely or uniformly, which may lead to longer drying times. In addition, the load may become tangled, requiring the user to untangle the load and possibly restart the drying cycle.

Figure 12:
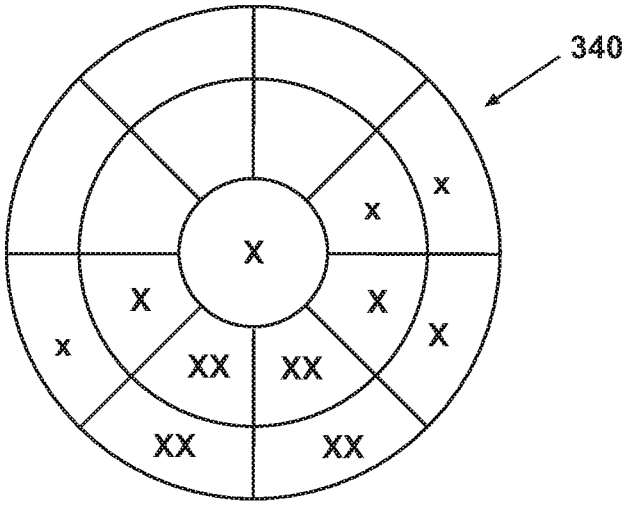
FIG. 12 is a schematic representation of an image of the treating chamber illustrating a sliding motion condition according to a sixth embodiment of the invention.

FIG. 12 illustrates an example of an integrated segmentation map 340 for a load of laundry that may be determined using steps 104 through 126 of the method 100 illustrated in FIG. 6. The segmentation map 330 may be utilized according to the method 300 to determine if a condition of concern is occurring and appropriate corrective measures may be applied as illustrated in FIG. 10. The "x" in each segment symbolizes the integrated percent coverage of the load in each segment over time; the larger and more numerous the "x", the larger the percent coverage. As may be seen in FIG. 12, the load is mostly located at the bottom of the drum 28, consistent with the condition of rolling or balling up of the load.

The map 340 is just one illustration of a rolling condition. A variety of rolling conditions may occur, producing a variety of integrated segmentation maps. The controller software may be programmed to differentiate between the different possible rolling conditions and determine which rolling conditions warrant corrective action. The threshold for determining what amount of rolling requires a corrective action may vary depending on the determined condition, the size and type of the load, the cycle and one or more operating parameters of the cycle.

As illustrated in method 300, the controller 14 may control the operation of the clothes dryer 10 to affect one or more corrective actions in step 308 consistent with the determined rolling condition. Examples of corrective action that may be taken to correct a rolling condition include: reversing the direction of rotation of the drum 28 and oscillating the direction of rotation of the drum. The controller 14 may implement successive corrective actions until the condition is corrected or may notify the user if the condition cannot be corrected.

Another example of a condition of concern is sliding. Sliding is a condition in which the laundry is not lifted by the lifters 36 as the drum rotates, but rather slide off the lifter 36, exposing generally the same surface area as the drum 28 rotates. Sliding may result in the load not being dried uniformly, which may lead to longer drying times and non-uniform application of a treatment.

An integrated segmentation map may be determined using steps 104 through 126 of the method 100 illustrated in FIG. 6 to determine the existence of a sliding condition. The segmentation map may be utilized according to the method 300 to determine if a sliding condition of concern is occurring and appropriate corrective measures may be applied as illustrated in FIG. 10. Examples of corrective action that may be taken to correct a sliding condition include: reversing the direction of rotation of the drum 28 and increasing the speed of rotation of the drum 28. As illustrated by method 300, the controller 14 may implement successive corrective actions until the condition is corrected or may notify the user if the condition cannot be corrected.

Another example of a condition of concern that may be determined using steps 104 through 126 of the method 100 is blocking of the air inlet 45 that fluidly connects the treating chamber 34 with the exhaust conduit 44. Blocking of the air inlet 45 may lead to diminished air flow, longer drying times or incomplete drying of the load. The method 100 may be used to determine a segmentation map having segments corresponding to the positions in front of the air inlet 45.

The segmentation map may be analyzed using the method 300 as illustrated in FIG. 10 to determine if the load is moving past the air inlet 45 or if one or more items of the load is stationary with respect to the air inlet 45 for some pre-determined length of time. If the controller 14 determines that one or more items of the load is stationary with respect to the air inlet 45, the controller 14 may determine that the air inlet 45 is blocked and corrective action is required.

As illustrated in method 300, the controller 14 may control the operation of the clothes dryer 10 to affect one or more corrective actions in step 308 consistent with the determined blockage condition. Examples of corrective action that may be taken to correct blockage of the air inlet 45 include: stopping the blower 46 while continuing to rotate the drum 28 and restarting the blower 46 when it is determined that the blockage is no longer present; or stopping both the drum 28 and the blower 46 and restarting both when it is determined that the blockage is no longer present.

Figure 13:
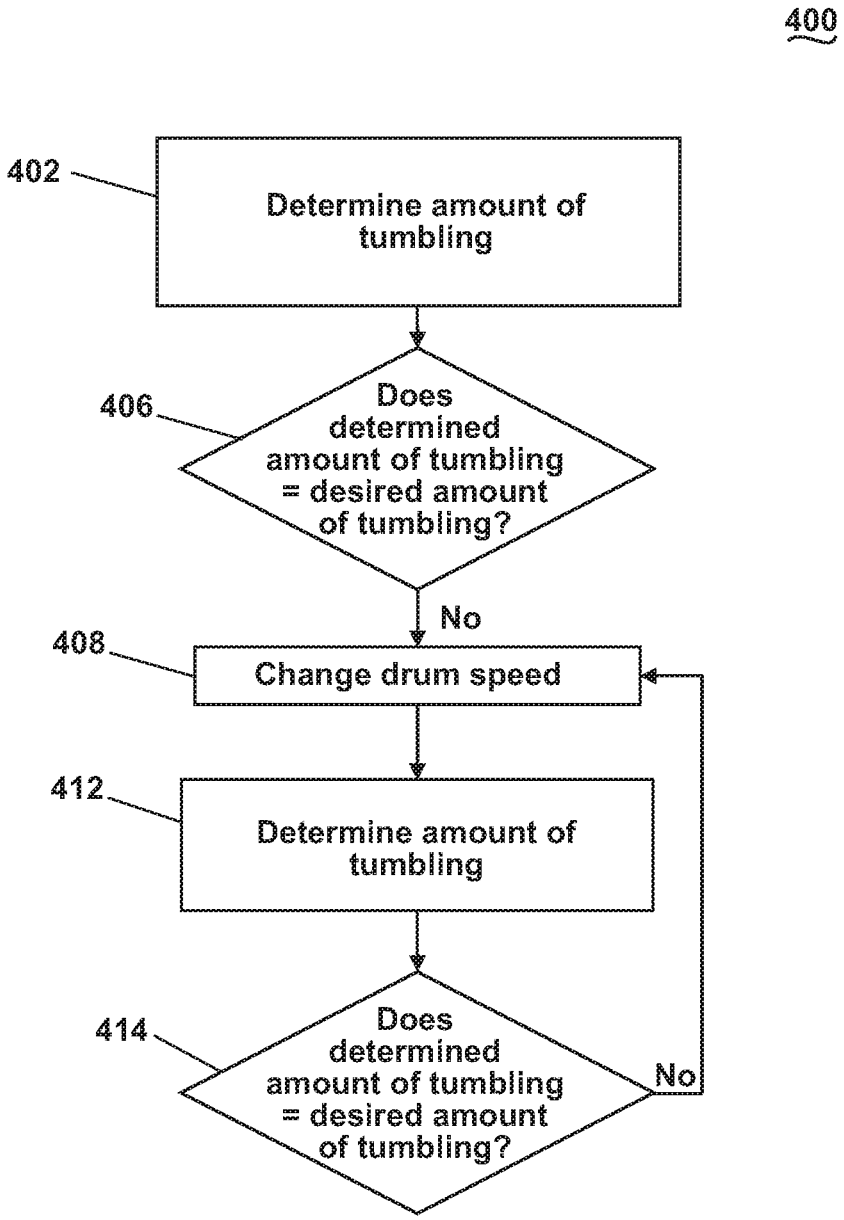
FIG. 13 is a flow chart illustrating a method for altering the speed of rotation of a dryer drum to obtain a desired amount of tumbling according to a seventh embodiment of the invention.

FIG. 13 illustrates a method 400 according to another embodiment of the invention for determining an amount of tumbling in the clothes dryer 10 and setting the speed of rotation of the drum 28 to achieve a desired amount of tumbling. The amount of tumbling may be determined using steps 104 through 126 of the method 100 illustrated in FIG. 6, or some other method. Tumbling may be a desired condition in a clothes dryer because it may lead to decreased drying times and more uniform application of a treatment.

According to method 400, in step 402 the amount of tumbling may be determined according to method 100, for example, by obtaining an integrated segmentation map. The integrated segmentation map may be analyzed using pattern recognition techniques or one or more functions to determine the absolute or relative amount of tumbling in the dryer drum 28. For example, an absolute determination of load tumbling may include determining that all of the load is tumbling and a tumbling condition exists or that a tumbling condition does not exist if any part of the load is not tumbling. Determining a relative amount of tumbling may include determining an amount of the load that is experiencing a tumbling condition relative to the entire load.

The determined amount of tumbling may then be compared to a desired amount of tumbling in step 406. The desired amount of tumbling may be determined automatically by the controller 14 based on the cycle of operation and/or one or more operating parameters. The operating parameters may be set by the user or determined automatically according to the method 200 or some other method. Examples of operating parameters that may be used to determine the desired amount of tumbling include the size and fabric type of the load.

If the determined amount of tumbling does not equal the desired amount of tumbling or does not fall within an acceptable range of a desired amount of tumbling, the speed of rotation of the drum 28 may be changed in step 408. The speed of the drum 28 may be increased or decreased depending on the difference between the determined amount of tumbling and the desired amount of tumbling. For example, if the determined amount of tumbling is higher than the desired amount of tumbling, the speed of the drum 28 may be decreased.

Once the drum 28 reaches the new speed set in step 408, an updated amount of tumbling may be determined in step 412 and analyzed to determine if the new amount of tumbling corresponds to the desired amount of tumbling. Steps 408-414 may be repeated until the determined amount of tumbling equals the desired amount of tumbling or falls within an acceptable range of desired tumbling. In this manner, the speed of rotation of the drum 28 may be controlled to provide the desired amount of tumbling for a given load of laundry based on conditions within the treating chamber 34. The method 400 may be used one or more times throughout the course of an operating cycle to adjust the speed of the drum 28 to provide the desired amount of tumbling.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the sequence of steps depicted in each method described herein is for illustrative purposes only, and is not meant to limit the disclosed methods in any way as it is understood that the steps may proceed in a different logical order or additional or intervening steps may be included without detracting from the invention.

What is claimed is:

1. A laundry treating appliance, comprising:

a laundry treating chamber;

an imaging device operably coupled with at least a portion of the laundry treating chamber, the imaging device adapted to capture multiple images of at least a portion of the laundry treating chamber, the multiple images defining image data that is representative of laundry in the laundry treating chamber, the imaging device adapted to output the image data; and a controller operably coupled to the imaging device and adapted to receive the output, and determine a motion condition of the laundry based on the image data to define a determined condition.

2. The laundry treating appliance of claim 1, further comprising at least one component operably coupled to the controller, the at least one component operable to implement at least a portion of a treating cycle of operation.

3. The laundry treating appliance of claim 2 wherein the controller is configured to control the at least one component, based on the determined condition.

4. The laundry treating appliance of claim 3 wherein the controller is configured to control the at least one component to set at least one of:

a rotational speed of a drum defining the laundry treating chamber;

a direction of rotation of the drum defining the laundry treating chamber;

a temperature in the laundry treating chamber;

an air flow through the laundry treating chamber;

at least one of a start and end of cycle condition;

at least one of a start and end of cycle step condition;

a rotational speed of an agitator;

a direction of agitator rotation; or a wash liquid fill level.

5. The laundry treating appliance of claim 2 wherein the at least one component is at least one of a heating element, a blower, a motor, a dispensing system, or a user interface.

6. The laundry treating appliance of claim 5 wherein the user interface provides an input and output function for the controller.

7. The laundry treating appliance of claim 6 wherein the controller is configured to operate the user interface to notify a user of the determined condition.

8. The laundry treating appliance of claim 7 wherein a portion of the user interface can be operated to emit an audible signal or a visual signal.

9. The laundry treating appliance of claim 8 wherein the portion of the user interface includes an indicator light configured to indicate the determined condition.

10. The laundry treating appliance of claim 8 wherein the determined condition is a condition of concern.

11. The laundry treating appliance of claim 10 wherein the controller is configured to send the signal after all pre-determined corrective actions for a given condition have been tried, after a pre-determined number of corrective actions have been tried, or after a pre-determined amount of time has elapsed since the condition was identified.

12. The laundry treating appliance of claim 7 wherein the determined condition is a condition of concern.

13. The laundry treating appliance of claim 1 wherein the determined condition includes at least one of rolling, tumbling, sliding, or satelliting.

14. The laundry treating appliance of claim 1 wherein the multiple images comprise at least two images and wherein the controller is adapted to define the motion condition from the at least two images.

15. The laundry treating appliance of claim 14 wherein the controller can use the motion condition to control the operation of the laundry treating appliance.

16. The laundry treating appliance of claim 15 wherein the controller is configured to control at least a portion of the laundry treating appliance based on the motion condition, to set at least one of:

a rotational speed of a drum defining the laundry treating chamber;

a direction of rotation of the drum defining the laundry treating chamber;

a temperature in the laundry treating chamber;

an air flow through the laundry treating chamber;

at least one of a start and end of cycle condition;

at least one of a start and end of cycle step condition;

a rotational speed of an agitator;

a direction of agitator rotation; or a wash liquid fill level.

17. The laundry treating appliance of claim 15 wherein the motion condition is at least one of rolling, tumbling, sliding, or satelliting.

18. The laundry treating appliance of claim 1 wherein the capturing of the multiple images includes digitally imaging motion of laundry in the laundry treating appliance with the imaging device.

19. The laundry treating appliance of claim 1 wherein the multiple images are captured using visible light.

* * * * *